US007988011B1

(12) United States Patent
Guevara

(10) Patent No.: US 7,988,011 B1
(45) Date of Patent: Aug. 2, 2011

(54) GARDENER'S WASTE CAN

(76) Inventor: Raul Guevara, Monterey Park, CA (US)

( * ) Notice: Subject to any disclaimer, the term of this patent is extended or adjusted under 35 U.S.C. 154(b) by 194 days.

(21) Appl. No.: 12/130,775

(22) Filed: May 30, 2008

Related U.S. Application Data

(60) Provisional application No. 60/998,083, filed on Oct. 9, 2007.

(51) Int. Cl.
*B65D 90/02* (2006.01)
*B65D 90/12* (2006.01)
*B65D 6/00* (2006.01)

(52) U.S. Cl. ..... 220/484; 220/628; 220/631; 220/666; 220/675; 220/769; 220/908; D34/1; 248/99

(58) Field of Classification Search ..... 220/484, 220/628, 631, 666, 675, 769, 908, 908.1, 220/910; D34/1, 7, 8, 10; 248/99
See application file for complete search history.

(56) References Cited

U.S. PATENT DOCUMENTS 1,212,305 A * 1/1917 Worsell ..... 294/55
2,906,061 A * 9/1959 Carlson ..... 47/41.01
3,170,183 A * 2/1965 Leatherman ..... 15/257.1
3,998,415 A * 12/1976 D'Antonio et al. ..... 294/1.1
4,600,113 A * 7/1986 DeMars ..... 220/212
5,011,103 A * 4/1991 Hayes et al. ..... 248/99
7,185,783 B1 * 3/2007 Miller ..... 220/675
D566,366 S * 4/2008 Aguilar ..... D34/1
7,441,675 B2 * 10/2008 McGinley et al. ..... 222/129

* cited by examiner

*Primary Examiner* — Anthony Stashick
*Assistant Examiner* — Madison L Wright
(74) *Attorney, Agent, or Firm* — John D. Tran

(57) ABSTRACT

A gardener's waste can includes a frusto-conical container having a flexible sidewall, a closed bottom end and an open top end defining a circular rim. An arcuate hinge is formed in the sidewall of the container. The hinge has opposite ends respectively intersecting the rim of the container and is arranged such that, when the sidewall of the container is laid against the ground, a hinged portion of the sidewall connected to the hinge and disposed between the two ends thereof swings inwardly into the container and lies generally flat against the ground so that leaves, cuttings on the ground are easily swept over the flat portion of the container sidewall and into the container.

20 Claims, 2 Drawing Sheets

GARDENER'S WASTE CAN

RELATED APPLICATIONS

This application claims benefit of U.S. provisional application ser. No. 60/998,083, filed Oct. 9, 2007, the entire disclosure of which is incorporated herein by reference.

BRIEF DESCRIPTION OF THE INVENTION

The present invention relates to an improved gardener's waste can or receptacle that is easier to carry and that can be staked in place so that leaves, grass cuttings and the like can be swept into it easily and without the need for assistance of a second person to hold the can.

BACKGROUND

A basic trash can of a type used by gardeners to hold leaves and cuttings is generally frusto-conical in shape and about 22 and half inches tall by about 19 inches in diameter at its upper end. The conventional can typically has two carrying handles disposed at its upper end on opposite sides of the can and a reinforcing lip that extending around the top rim that is adapted to mate with a corresponding lid that acts as a closure for the can.

The opening at the top of the conventional can is circular, and because of the reinforcing lip around the opening, when the can is laid on its side on the ground, the opening of the can touches the ground at only a single point, i.e., the point at which the can opening is tangent to the ground. This makes it difficult to sweep leaves and cuttings into the can. Additionally, during the sweeping operation, it is necessary for the sweeper or an assistant to hold the can in place to prevent the can from moving away from the sweeper's rake or broom. Finally, the can's carrying handles are placed awkwardly for using the can as a scoop for scooping up large piles of leaves or cuttings and for dumping the contents of the can into a larger receptacle.

SUMMARY

In accordance with the present disclosure, an improved gardener's waste can is provided that is easier to carry and to use as a scoop and that can be staked in place on the ground so that leaves, cuttings and the like on the ground can be swept into it easily and without the need for the sweeper or an assistant to hold the can in place manually.

In one exemplary embodiment, a gardener's waste can includes a frusto-conical container having a flexible sidewall, a closed bottom end and an open top end defining a circular rim. An arcuate hinge is formed in the sidewall of the container. The hinge has opposite ends respectively intersecting the rim of the container and is arranged such that, when the sidewall of the container is laid against the ground, a hinged portion of the sidewall connected to the hinge and disposed between the two ends thereof swings radially inward into the container and lies generally flat against the ground.

A pair of circumferential bearings may be disposed on opposite sides of the container and bilaterally symmetrical to the hinge. Each bearing may have a respective stake slidably disposed therein. The stakes may be arranged to move up and down in penetrating engagement and disengagement with the ground when the hinged portion of the sidewall of the container is laid flat against the ground, so as to prevent movement of the container relative to the ground when leaves, cuttings and the like are being swept into the container without the need to hold the can in place manually.

A recess may disposed in the sidewall of the container at the bottom end thereof and diametrically opposite to the hinge, and first handle may be disposed in the recess and extend generally parallel to a long axis of the container. A second handle may be disposed on the sidewall of the container at the top end thereof and diametrically opposite to the hinge, and may extend generally perpendicular to the long axis of the container. The handles, in conjunction with the flat portion of the container sidewall, enable the waste can to be used like a large scoop for scooping leaves, cuttings and the like on the ground into the container, and additionally, for emptying the contents of the can into another receptacle, such as a cuttings bag.

A better understanding of the above and many other features and advantages of the novel gardener's waste can of the present invention may be obtained from a consideration of the detailed description of some example embodiments thereof below, particularly if such consideration is made in conjunction with the several views of the appended drawings, wherein like elements are referred to by like reference numerals throughout.

DETAILED DESCRIPTION

Figure 1:
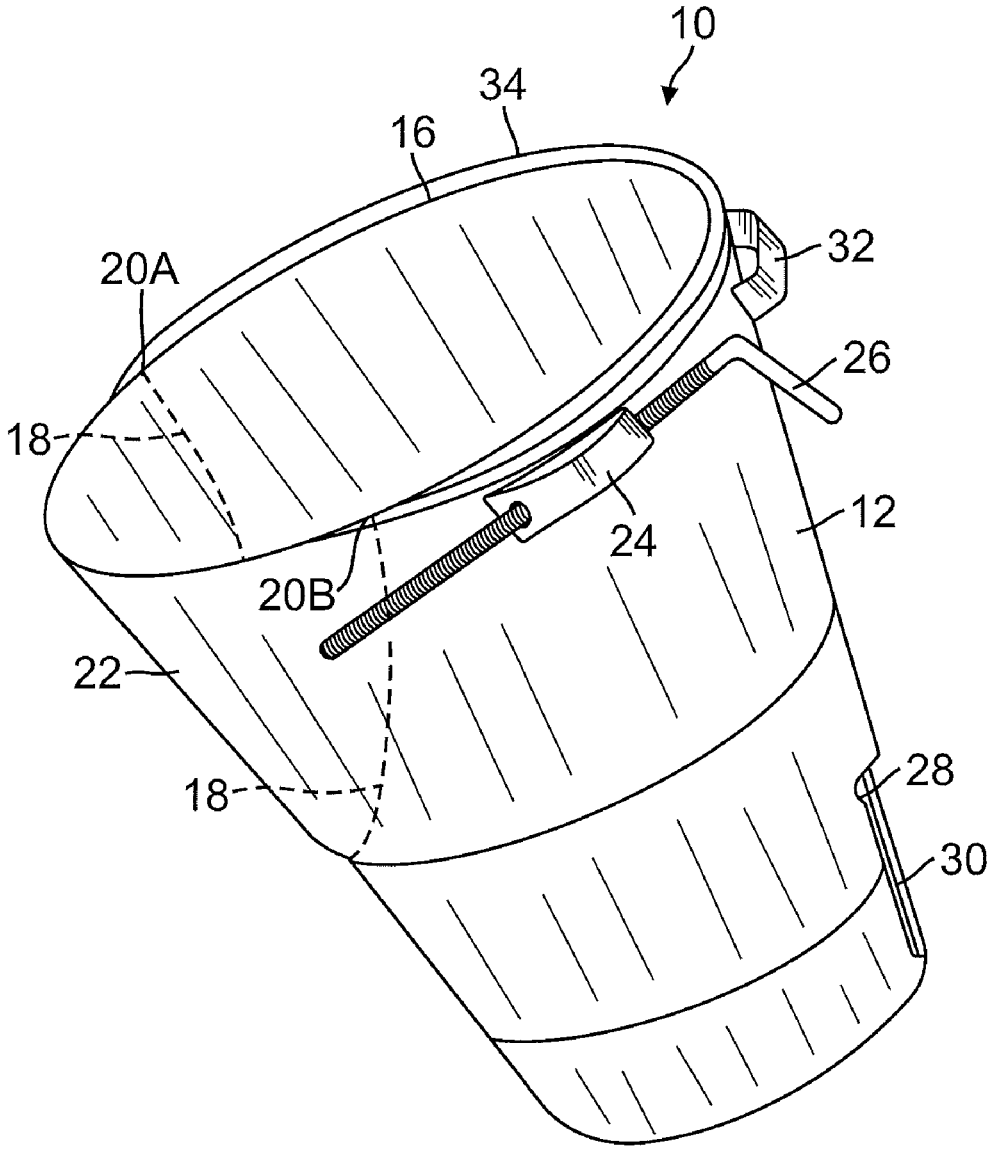
FIG. 1 is a top and side perspective view of an exemplary embodiment of a gardener's waste can in accordance with the present invention.
Figure 2:
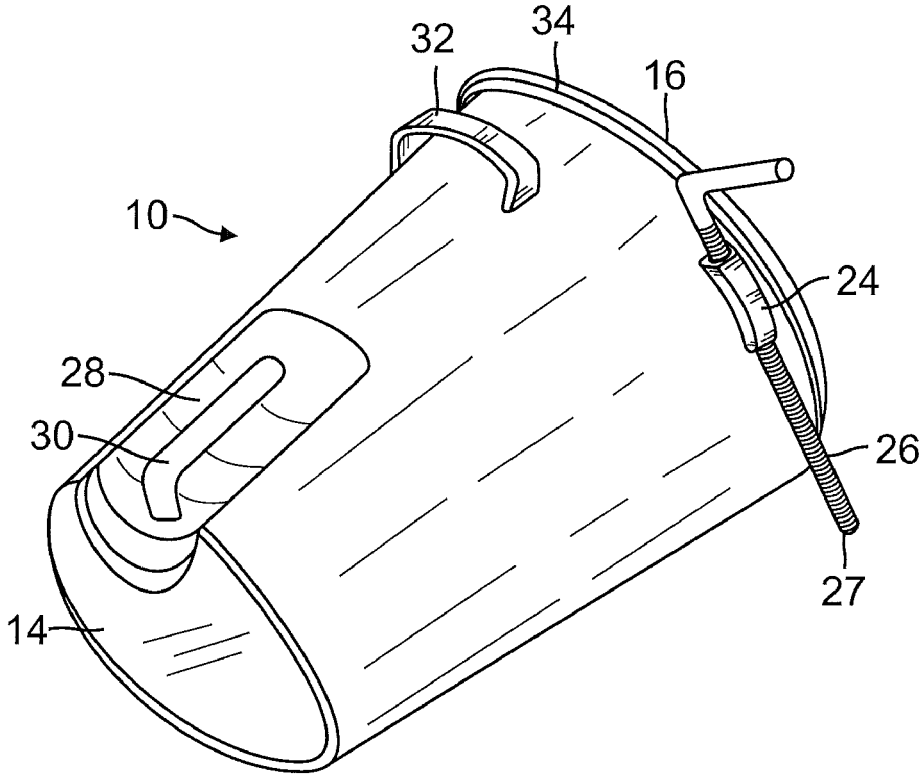
FIG. 2 is a bottom and side perspective view of the exemplary gardener's waste can; and, FIG. 3 is front end elevation view of the exemplary waste can, showing a hinged sidewall portion of the can swung radially inward into the container and lying flat against the ground.

FIGS. 1 and 2 are top and bottom side perspective views of an exemplary embodiment of a gardener's waste can 10 in accordance with the present invention. With reference to FIGS. 1 and 2, the exemplary waste can comprises a generally frusto-conical container 12 having a flexible sidewall, a closed bottom end 14, and an open top end defining a peripheral rim 16. An arcuate hinge 18 is formed in the sidewall of the container. The hinge includes opposite ends 20A and 20B that respectively intersect the rim 16 of the container, and as illustrated in FIG. 3, is arranged such that, when the sidewall of the container is laid against the ground 1, a hinged portion 22 of the sidewall, i.e., the portion connected to the hinge and disposed between the two ends thereof, swings radially inward into the container and lies generally flat against the ground, so that leaves, cuttings and the like (not illustrated) on the ground can be easily swept into the container with a rake or a broom.

In one embodiment, the hinge 18 may incorporate the shape of a conic section, e.g., a hyperbola, and may comprise a so-called "solid hinge," i.e., one including, e.g., one or more small, parallel corrugations, or alternatively, serrations formed directly into the flexible sidewall of the container 12 such that the flexibility of the sidewall at the hinge is substantially greater than in the sidewall portions adjacent thereto.

Figure 3:
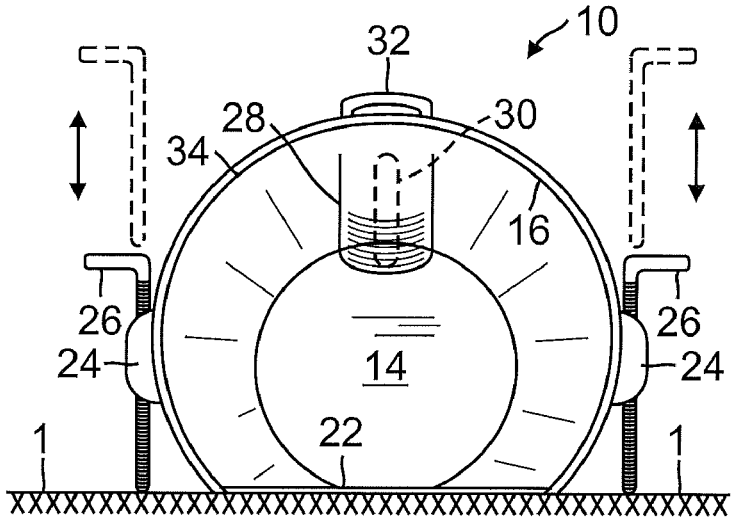

As illustrated in, e.g., FIG. 3, the exemplary waste can 10 may further include a pair of circumferential bearings 24 that are disposed on opposite sides of the container 12 and bilaterally symmetrical to the hinge 18. Each of a pair of stakes 26 is slidably disposed in a respective one of the bearings and, as illustrated by the respective dashed line outlines of FIG. 3, is arranged to move up and down in penetrating engagement and disengagement with the ground 1 when the hinged portion 22 of the sidewall of the container is laid flat against the ground. As illustrated in FIG. 3, the stakes may be L-shaped, made of a strong metal, and include a pointed end 27 adapted to penetrate the ground. In one embodiment, each of the two stakes may be about 13 inches long, about a quarter of an inch in diameter and may have 6 inch long handle portions. In use, the stakes are pressed into the ground so as to prevent movement of the container relative to the ground when leaves, cuttings and the like are being swept into the container, thus making it unnecessary for the sweeper or an assistant to hold the can in place to prevent it from moving away from the sweeper's rake or broom. When the sweeping operation is complete, the stakes are easily withdrawn from the ground and the can is lifted upright.

As illustrated in FIGS. 1-3, the exemplary waste can 10 may further include a recess 28 disposed in the sidewall of the container 12 at the bottom end 14 thereof and diametrically opposite to the hinge 18. a first handle 30 may be disposed in the recess and, as illustrated in FIG. 2, extend generally parallel to a long or vertical axis of the container 12. A second handle 32 may be disposed on the sidewall of the container at the top end thereof and diametrically opposite to the hinge, and as illustrated in, e.g., FIG. 3, may extend generally perpendicular to the long axis of the container. As those of skill in the art will appreciate, the two handles 30, 32, in conjunction with the flat hinged portion 22 of the container sidewall, enable the waste can to be used like a large scoop for scooping leaves, cuttings and the like on the ground into the container. The handles 30, 32 also make it much easier to carry garden waste in the can and to dispose of it, e.g., by pouring it, into a larger receptacle (not illustrated), such as a mulch bin or plastic leaf bag.

As illustrated in the figures, the exemplary waste can 10 may further include a reinforcing flange or lip 34 that extends around a portion of the rim 16 of the container disposed opposite to the hinge 18 and between the ends 22A and 22B thereof. The lip 34 is adapted to engage within a mating cover or lid (not illustrated) of the can, as in a conventional waste can, but is omitted from the rim of the hinged portion 22 of the container sidewall to enable the hinged portion to flex radially in the manner described above and illustrated in FIG. 3. In one exemplary embodiment, the portion of the rim of the can from which the reinforcing lip is omitted, i.e., between the two end points 20A and 20B of the hinge 18, has a circumferential length of about 13 inches.

In one preferred embodiment, the container 12 of the waste can 10 is molded from a strong, flexible, durable, rust-free plastic, such as polyurethane or acrylonitrile butadiene styrene (ABS). Alternatively, the hinge 18, the hinged portion 22 of the container sidewall and a portion of the container sidewall including the recess 28 and the first handle 32 may molded of such a plastic, and the balance of the container may be made of a strong, corrosion resistant metal, such as galvanized steel, with the plastic portions bonded or molded into corresponding cutouts formed therein.

As those of skill in the art will appreciate, although the methods and apparatus of the present disclosure have been described and illustrated herein with reference to certain specific example embodiments thereof, a wide variety of modifications and variations may be made to them without departing from the spirit and scope of the invention. In light of this, the scope of the present invention should not be limited to that of the specific example embodiments described and illustrated herein, but rather, should be commensurate with that of the claims appended hereafter and their functional equivalents.

What is claimed is:

1. A gardener's waste can, comprising:

a frusto-conical container having a flexible sidewall, a closed bottom end and an open top end defining a circular rim;

an arcuate hinge formed in the sidewall of the container, the hinge having opposite ends respectively intersecting the rim of the container and being arranged such that, when the sidewall of the container is laid against a surface, a hinged portion of the sidewall connected to the hinge and disposed between the two ends thereof swings radially inward into the container and lies generally flat against the surface; and a pair of bearings disposed on opposite sides of the container, positioned on the flexible sidewall and bilaterally symmetrical to the hinge, each of the bearings including an elongated slot that extends in a direction parallel to a plane defined by the circular rim.

2. The waste can of claim 1, further comprising:

a pair of stakes, each slidably disposed in the elongated slot of a respective one of the bearings and arranged to move up and down in penetrating engagement and disengagement with the surface when the hinged portion of the sidewall of the container is disposed flat against the surface.

3. The waste can of claim 1, further comprising:

a recess disposed in the sidewall of the container at the bottom end thereof and diametrically opposite to the hinge;

a first handle disposed in the recess and extending generally parallel to a long axis of the container; and, a second handle disposed on the sidewall of the container at the top end thereof and diametrically opposite to the hinge, the second handle extending generally perpendicular to the long axis of the container.

4. The waste can of claim 1, further comprising a reinforcing lip extending around a portion of the rim of the container diametrically opposite to the hinge and extending between the two opposite ends thereof.

5. The waste can of claim 1, wherein the container is molded from a plastic.

6. The waste can of claim 2, wherein the stakes are L-shaped, made of a metal, and include a pointed end adapted to penetrate the surface.

7. The waste can of claim 1, wherein the hinge comprises a plurality of corrugations or serrations formed in the sidewall of the container.

8. The waste can of claim 1, wherein the hinge and the hinged portion of the container sidewall are made of a flexible plastic.

9. The waste can of claim 3, wherein the hinge, the hinged portion of the container sidewall and a portion of the container sidewall including the recess and the first handle are made of a flexible plastic.

10. A method for using a gardener's waste can, the method comprising:

providing the gardener's waste can of claim 1;

laying the sidewall of the container against the surface such that the hinged portion of the sidewall swings inwardly into the container and lies generally flat against the surface; and, sweeping leaves, cuttings and the like on the surface into the container over the flat portion of the container sidewall.

11. A method for using a gardener's waste can, the method comprising:

providing the gardener's waste can of claim 2;

laying the sidewall of the container against the surface such that the hinged portion of the sidewall swings inwardly into the container and lies generally flat against the surface;

pressing down on an upper end of each of the stakes until a lower end of each of the stakes penetrates into the surface and thereby locks the container against movement relative to the surface; and, sweeping leaves, cuttings and the like on the surface into the container over the flat portion of the container sidewall.

12. A method for using a gardener's waste can, the method comprising:

providing the gardener's waste can of claim 3;

grasping each of the first and second handles in a respective hand;

laying the sidewall of the container against the surface such that the hinged portion of the sidewall swings radially inward into the container and lies generally flat against the surface; and, urging the container forward along the surface such that leaves, cuttings and the like on the surface are scooped into the container over the flat portion of the container sidewall.

13. A gardener's waste can, comprising:

a frusto-conical container having a flexible sidewall, a closed bottom end and an open top end defining a circular rim;

an arcuate hinge formed in the sidewall of the container, the hinge having opposite ends respectively intersecting the rim of the container and being arranged such that, when the sidewall of the container is laid against a surface, a hinged portion of the sidewall connected to the hinge and disposed between the two ends thereof swings radially inward into the container and lies generally flat against the surface;

a pair of bearings disposed on opposite sides of the container and bilaterally symmetrical to the hinge, each of the bearings including an elongated slot that extends in a direction tangential to a circumference of the container sidewall;

a pair of stakes, each slidably disposed in the elongated slot of a respective one of the bearings and arranged to move up and down in penetrating engagement and disengagement with the surface when the hinged portion of the sidewall of the container is disposed flat against the surface;

a recess disposed in the sidewall of the container at the bottom end thereof and diametrically opposite to the hinge;

a first handle disposed in the recess and extending generally parallel to a long axis of the container; and, a second handle disposed on the sidewall of the container at the top end thereof and diametrically opposite to the hinge, the second handle extending generally perpendicular to the long axis of the container.

14. The waste can of claim 13, further comprising a reinforcing lip extending around a portion of the rim of the container diametrically opposite to the hinge and extending between the ends thereof.

15. The waste can of claim 13, wherein the container is molded from a plastic.

16. The waste can of claim 13, wherein the stakes are made of a metal, have a first end adapted to be grasped by hand and an opposite second end pointed so as to penetrate the surface.

17. The waste can of claim 13, wherein the hinge comprises a plurality of corrugations or serrations formed in the sidewall of the container.

18. The waste can of claim 13, wherein the hinge, the hinged portion of the container side wall and a portion of the container sidewall including the recess and the first handle are made of a flexible plastic.

19. A method for using the waste can of claim 13, the method comprising:

laying the sidewall of the container against the surface such that the hinged portion of the sidewall swings inwardly into the container and lies generally flat against the surface;

pressing down on an upper end of each of the stakes until a lower end of each of the stakes penetrates into the surface and thereby locks the container against movement relative to the surface; and, sweeping leaves, cuttings and the like on the surface into the container over the flat portion of the container sidewall.

20. A method for using the waste can of claim 13, the method comprising:

grasping each of the first and second handles in a respective hand;

laying the sidewall of the container against the surface such that the hinged portion of the sidewall swings inwardly into the container and lies generally flat against the surface; and, urging the container forward along the surface such that leaves, cuttings and the like on the surface are scooped into the container over the flat portion of the container sidewall.

* * * * *